United States Patent [19]

Felix

[11] Patent Number: 4,888,944

[45] Date of Patent: Dec. 26, 1989

[54] PROCESS AND APPARATUS FOR PRODUCTION AND QUALITY CONTROL IN MULTI-SPINDLE TEXTILE MACHINES

[75] Inventor: Ernst Felix, Uster, Switzerland

[73] Assignee: Zellweger Uster AG, Uster, Switzerland

[21] Appl. No.: 170,410

[22] Filed: Mar. 18, 1988

[30] Foreign Application Priority Data

Mar. 19, 1987 [CH] Switzerland ..... 01042/87

[51] Int. Cl.[4] ..... D01H 13/26; D01H 13/44; D01H 13/22

[52] U.S. Cl. ..... 57/264; 57/81; 57/265; 340/677

[58] Field of Search ..... 57/80, 81, 261–265, 57/352, 75; 340/677

[56] References Cited

U.S. PATENT DOCUMENTS

| | | | |
|---|---|---|---|
| 3,621,267 | 11/1971 | Dent | 250/219 S |
| 3,950,927 | 4/1976 | Kallman | 57/265 |
| 4,058,962 | 11/1977 | Spescha et al. | 57/81 X |
| 4,095,401 | 6/1978 | Mori et al. | 57/81 |
| 4,122,657 | 10/1978 | Felix | 57/81 |
| 4,160,360 | 7/1979 | Carvalho et al. | 57/81 |
| 4,168,604 | 9/1979 | Mannhart | 57/264 |
| 4,256,247 | 3/1981 | Loeffe | 57/81 X |
| 4,330,094 | 5/1982 | Mayer | 57/265 X |
| 4,399,648 | 8/1983 | Kato | 57/265 |
| 4,491,831 | 1/1985 | Sakai et al. | 340/677 |
| 4,512,028 | 4/1985 | Stutz | 57/265 X |

FOREIGN PATENT DOCUMENTS 2134527 1/1973 Fed. Rep. of Germany .

*Primary Examiner*—John Petrakes

*Attorney, Agent, or Firm*—Burns, Doane, Swecker & Mathis

[57] ABSTRACT

A common monitoring system with a light beam is provided for a group of two or more production units arranged in a row. The beam passes through the thread balloon formed by the moving thread of each of these production units and is intermittently interrupted or attenuated by the moving thread in each balloon. The resulting shading is converted into an electric signal in a receiver of the monitoring system.

The threads of the individual production units can be identified by evaluating the relationships of amplitude, time and phase between the individual shading impulses.

The process enables on-line production and quality control to be carried out on multi-spindle textile machines such as ring spinning machines at an acceptable cost.

22 Claims, 5 Drawing Sheets

PROCESS AND APPARATUS FOR PRODUCTION AND QUALITY CONTROL IN MULTI-SPINDLE TEXTILE MACHINES

BACKGROUND AND FIELD OF THE INVENTION

In the textile industry, there are many production machines in which a large number of production units are in operation at the same time. As examples may be mentioned spinning machines, bobbin winding machines and yarn twisting machines. There is an obvious need for automatic monitoring of each individual production unit for the smooth progress of production and the quality produced. For checking the production process, the most important factor to monitor is thread breakage, and for quality control the most important factor is the cross-section of the twisted yarn which serves as a check on whether all the threads have been twisted in.

Although the term "thread" is consistently used in the following description, it should be understood to include all products of spinning, such as yarns, twisted threads or yarns, strands, filaments, and the like.

The above-mentioned monitoring of all the individual production units could be technically solved with known means but has hitherto not been realized on account of the costs involved. Owing to the large number of production units only a minimum expenditure of cost per production unit would be affordable if the cost per machine is to be kept within acceptable limits.

For detecting thread breakage in ring spinning machines, installations which have so-called travelling sensors have recently appeared on the market. These are able to monitor the movements of the ring traveller of a whole side of a ring spinning frame with a single sensor. This solution is acceptable from the point of view of cost for detecting thread breakage but it cannot be used for measuring other thread parameters because the signal is produced by the rotating ring traveller and not by the thread itself.

No economically feasible solutions have hitherto been found for determining the thread cross-section and/or its non-uniformity directly at the production unit of ring spinning frames, twisting frames, and the like.

SUMMARY AND OBJECT OF THE INVENTION

An object of the invention is to provide a process and apparatus which enables the production and quality of production units on multi-spindle textile machines to be monitored at an acceptable cost.

The invention relates to a process for production and quality control of the production units of multi-spindle textile machines, in which the production units are arranged in a row and the thread traveling in each production unit executes a transverse movement to form a sort of balloon describing the surface of a rotationally symmetrical body which will hereinafter be referred to as a space element.

The process according to the invention is characterized in that a monitoring device carrying a beam of light is provided for each of a plurality of groups of two or more production units. Within each group, the beam of light is passed through all the space elements at the production units of the group and is therefore intermittently interrupted or attenuated in each space element by the moving thread. The resulting shading or reduction in intensity of light is converted into an electric signal in a receiver and used as basis for further interpretation.

The basic idea of the invention is therefore that several production units are monitored by a common monitoring system so that the costs per production unit are considerably reduced. One beam of light is in each case passed through several thread balloons, the cross-section of the beam being preferably small in proportion to the diameter of the balloon. When the textile machine is in the operational state, each thread passes through the light beam twice with each revolution. There is a high degree of probability that there will be a certain point in time when only one single thread is situated in the path of the beam. The smaller the number of production units, the higher is this probability, but it is absolutely necessary for each thread to traverse the beam entirely on its own because otherwise the measurement would be falsified. Since the movements of rotation of the individual threads are generally not accurately synchronized but take place at random, the chance of each individual thread being measured at some point in the course of time is in fact a certainty.

In textile machines with a very large number of production units in a row (for example above 100), it is advisable not to pass the light beam through all the balloons but to subdivide them into several groups. The size and number of these groups is a matter of judgment and will be determined by practical parameters. In particular, the probability of only one thread lying in the path of the beam progressively decreases as the number of production units increases and if the distance between transmitter and receiver increases then the intensity of light may become insufficient. This does not apply, of course, to laser beams.

This invention also relates to an apparatus for carrying out the above-mentioned process comprising a monitoring device. The apparatus according to the invention is characterized in that two or more production units are allocated to a common monitoring device which comprises a transmitter for a beam of rays and a receiver for this beam and is so arranged that the beam passes through the space elements at the aforesaid two or more production units, and means are provided for evaluating the fluctuations in intensity of the beam occurring at the receiver.

In one mode of evaluation, the goal is to monitor the textile apparatus for thread breaks and the like. Since each passage of a thread through the light beam results in the production of an electrical impulse, a diminution in the number of impulses produced in a selected time interval may be used as an indication that not all of the production units in the group being monitored are forming balloons in the intended manner. In such evaluations, statistical procedures may be used to guard against false indications such as might occur if one did not take into account the unlikely possibility of threads from more than one production unit crossing the light beam at the same moment to produce only one electrical impulse instead of the expected two impulses. For example, the probability of a false indication may be reduced by withholding a thread break indication until multiple impulse counts over a plurality of spaced apart time intervals have all shown deficiencies from the expected number of impulses.

It also is a feature of the invention that, when desired, the evaluation system have a capability of distinguishing impulses formed by one thread from impulses formed by other threads being processed in the group of production units being monitored in common by a single system. By suitably arranging the light path in relation to the balloons at the several production units, one can cause the impulses derived from one thread to differ from other impulse in their shapes and/or in their timing. In this way the evaluation system may provide information (e.g., thread presence or absence, thread diameter, etc.) about the threads at identified ones of the production units being monitored in common.

BRIEF DESCRIPTION OF THE DRAWINGS

The invention is described below with the aid of exemplary embodiments and the drawings, in which.

DETAILED DESCRIPTION OF PREFERRED EMBODIMENTS

Figure 1A:
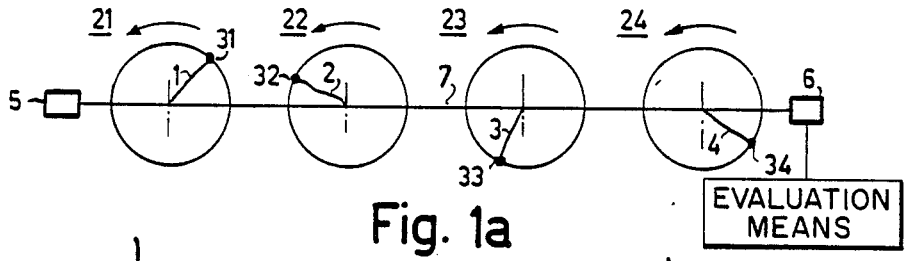
FIG. 1*a* is a schematic plan view of a number of production units.
Figure 1B:
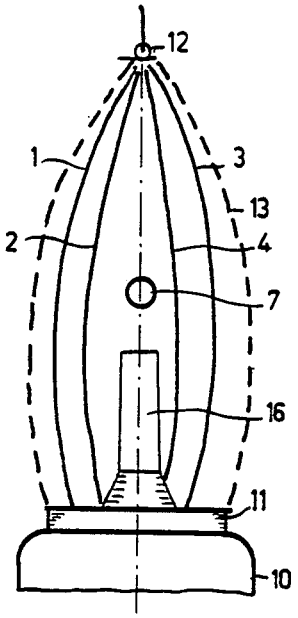
FIG. 1*b* is a side view of the production units of FIG. 1*a* seen from the left.

FIGS. 1*a* and 1*b* show schematically four production units 21, 22, 23 and 24 which consist of spindles of a ring spinning frame. The figures show the ring rail 10, the ring 11, a thread guide 12 (the so-called piglet's tail) and a spindle 16. At each production unit, a thread 1, 2, 3, 4 runs from the thread guide 12 to the ring 11 and forms a balloon 13 in which it is situated at any given moment in an instantaneous position such as 31, 32, 33 or 34.

The four production units 21 to 24 arranged in a row are allocated to a common monitoring device which comprises a transmitter 5 for a beam of light 7 and a receiver 6 for this beam. The beam 7 passes through the center of the balloon 13 and is therefore repeatedly traversed by each rotating thread 1 to 4, in fact twice per rotation. Each intersection of the beam by a thread is accompanied by an attenuation or shading of the light received by the receiver 6.

In the textile machines to which this description is applicable, all the balloons of a given machine rotate at about the same speed but their rotation is not synchronized. The time for one revolution is therefore known at least approximately. If a monitoring device is provided for four production units, as in the examples illustrated, and shading occurs eight times (2 times 4) per revolution, then all the threads are intact.

Figure 2:
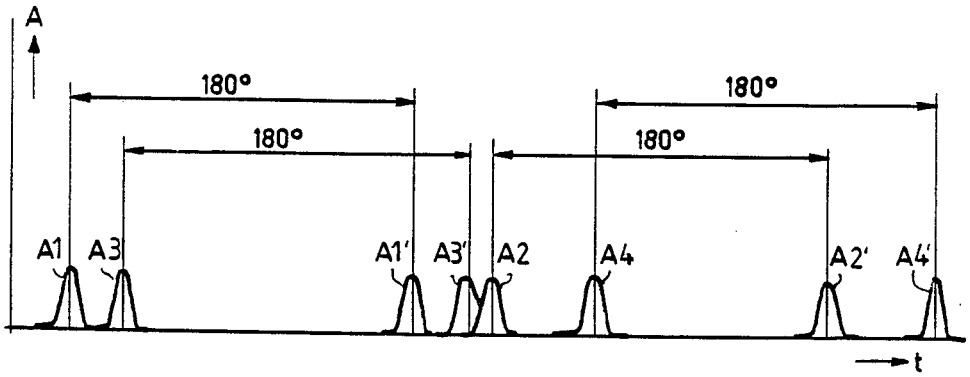
FIG. 2 is a first impulse diagram.

FIG. 2 shows a corresponding impulse diagram in which the time t is plotted along the abscissa and the shading A of the beam by the threads 1, 2, 3 and 4 is plotted along the ordinate. Each shading by one of the threads 1 to 4 is represented symbolically by a shading impulse A1 to A4, and A1' to A4'. The impulse sequence is purely arbitrary but the impulses are always separated by a half period of 180°.

It is purely by way of example that the beam 7 is shown to pass through the center of the balloon 13. The beam could equally well be shifted in a parallel direction, for example, or placed obliquely as in FIGS. 3*a* and 3*b* to enclose an angle a with the horizontal H and an angle b with the line K connecting the axes of the production unit 21, 22, 23 and 24.

For certain purposes, more than one beam may be used. Several beams may be produced by a single light transmitter 5 with several light-sensitive receivers 6, 6' (FIG. 5) or with several light transmitters 5 and a single light-sensitive receiver 6. The description given below is limited to only a few examples. From the time sequence and the intensity of the shading impulse, conclusions can be drawn as to the diameter of the thread.

The description will first be confined to the determination of thread breakages. Additional explanations necessary for determining the thread cross-section will be given at the end of the examples.

With the recognition of a thread breakage within a production group, the problem is only partly solved. The second part of the problem lies in detecting the position in the production units 21, 22, 23, 24 where the thread breakage occurred, i.e. in identifying the production unit.

Figure 3A:
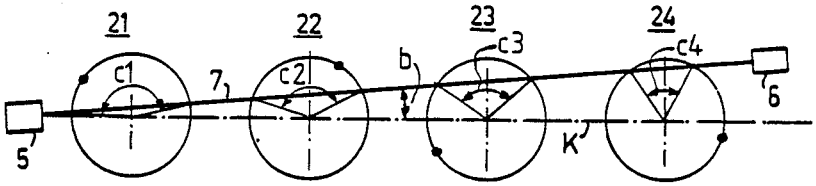
FIGS. 3*a* 3*b* show a first variation of the arrangement of FIG. 1*a* in plan view and in side view.
Figure 3B:
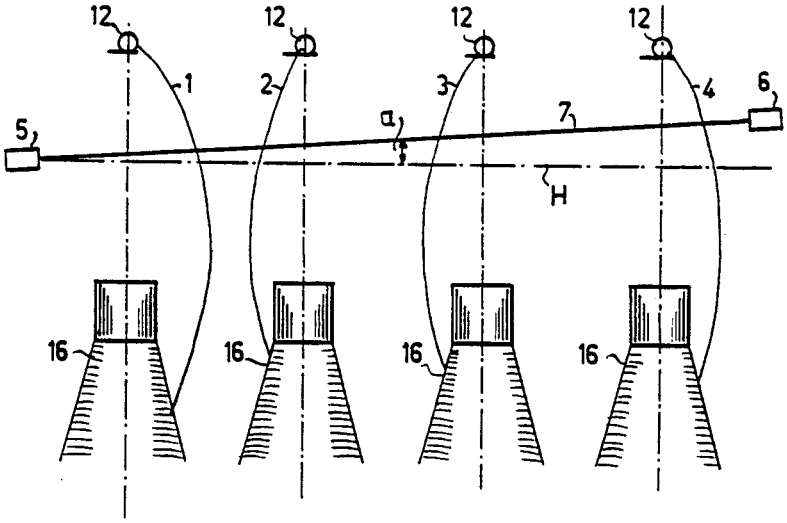
Figure 4:
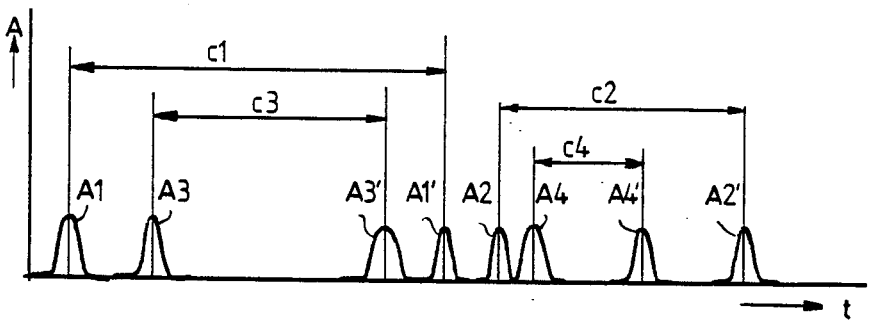
FIG. 4 is a second impulse diagram.

This problem may be solved, for example, in an arrangement shown in FIG. 3*a*. The beam 7 in this case does not pass through the center of the thread balloon but at various distances from the center. In contrast to FIG. 1, in which a possible thread breakage is detected after exactly one half period of rotation, the time for detection varies in this example. It will easily be seen that the intervals between impulses always correspond to an angle c or an angle representing the difference between 360° and the angle c. A corresponding impulse diagram is shown in FIG. 4, in which the different angles are also represented.

The interpretation of the individual impulses, i.e. the relationship between them, requires care. If sufficient time is available for evaluation, the problem may be solved by statistics. In general, a thread breakage need not necessarily be detected with the first revolution. When a sufficiently large number of revolutions have taken place, displacements invariably occur due to the non-synchronous movement of the individual production units so that the production unit affected can be identified completely according to the laws of statistics, e.g. by autocorrelation.

Figure 5:
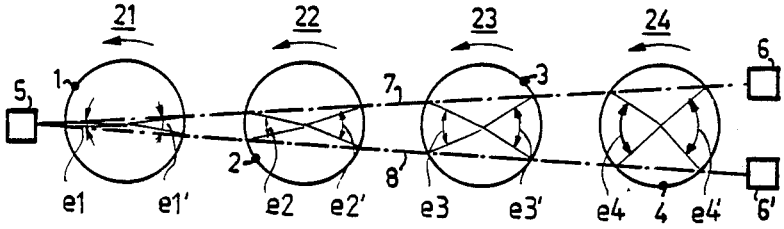
FIG. 5 shows a second variation of the arrangement of FIG. l*a* in plan view.

Determination of the thread which has caused shading can be considerably facilitated by using a second light beam. This may be realized as shown in FIG. 5 by using one transmitter 5 with two receivers 6, 6' or by using two transmitters with one receiver. In either case, two diverging or converging beams 7, 8 are obtained. It is, of course, also possible to use two transmitters 5 and two receivers 6.

Figure 6:
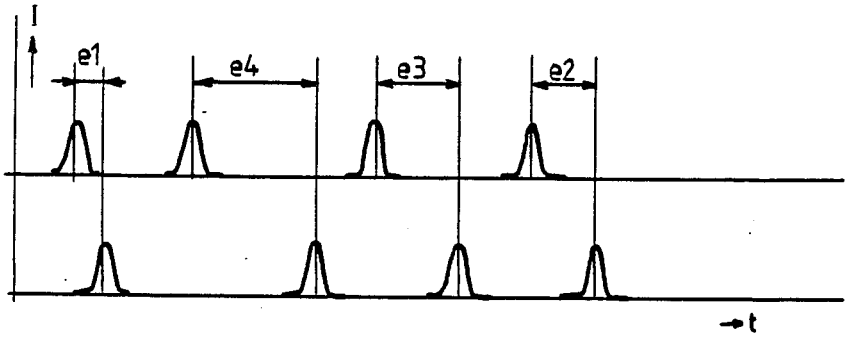
FIG. 6 is a third impulse diagram.

Since, as already mentioned, the speeds of rotation of all the balloons are approximately equal, the positions of the production units 21, 22, 23, 24 can be reliably determined from the time which elapses between the passage of the thread through the beam 7 and its passage through the beam 8. Thus, in FIG. 5 the impulses are obviously very close together in spindle 21 and furthest apart in spindle 24. The distance between the locations of the impulses in each case corresponds to an angle e (e1, e2, e3, e4) and their allocation to the appropriate spindle is obvious. FIG. 6 shows the impulse diagrams of the shadings in the two beams 7, 8.

A case could arise that by coincidence certain impulses could be allocated to any of several spindles. In that case, the allocation of impulses to spindles should first be confined to those cases which are completely clear, and further measurements may then be carried out at a later stage when the positions of the threads in relation to one another has completely changed. The probability of the magnitude of the time interval within which the presence of all the threads can be determined may be calculated according to the laws of statistics.

Figure 7:
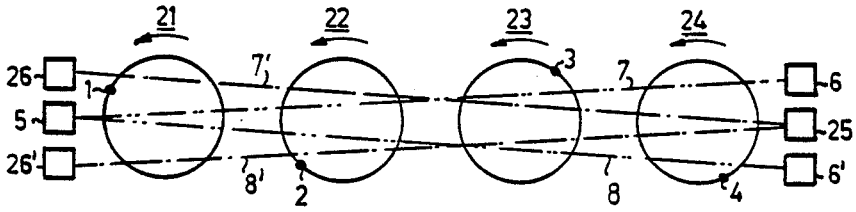
FIG. 7 shows a third variation of the arrangement of FIG. 1*a* in plan view.

In order to determine even more easily and unequivocally which individual shading impulses belong to which spindles, the arrangement of FIG. 5 may be modified as shown in FIG. 7 in which an additional transmitter 25 is provided between the two receivers 6, 6' (FIG. 5) and an additional receiver 26 and 26' respectively, is arranged on each side of the transmitter 5. Two pairs of beams 7, 8 and 7', 8', then pass through the balloons. Interpretation of the shading impulses at the receivers 6, 6' and 26, 26' is carried out separately for each pair of receivers in the manner described for FIGS. 5 and 6 and the signals of the two pairs of receivers are brought into relationship with one another. The allocation of the shading impulses to the individual spindles then becomes clearer and more reliable but the costs are also higher.

Figure 8:
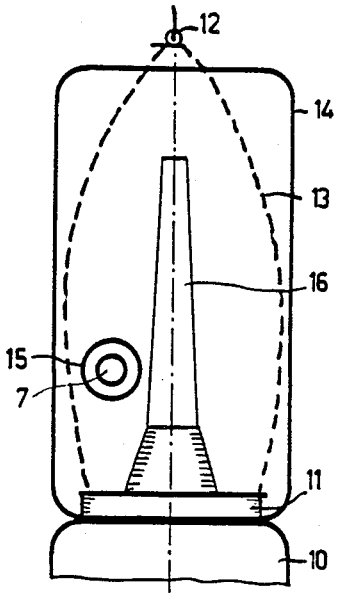
FIG. 8 shows a constructional detail of a production unit.
Figure 9:
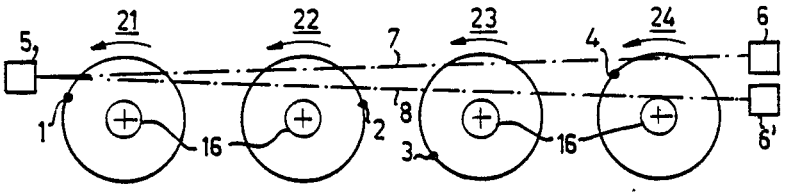
FIGS. 9–11 show each a further variation of the arrangement of FIG. 1*a* in plan view.

In many production machines, the individual production units are separated from one another by separators. This is shown in FIG. 8 on a ring spinning machine which is used as an example. The balloon 13 between the thread guide 12 and the ring 11 forms on the ring rail 10 as in FIG. 16 but in this case the ring rail 10 carries an opaque separator 14 for each spindle. Moreover, the spindle 16 is longer than in FIG. 1*b* so that the light beam 7 cannot be passed centrally through the balloon 13, at least not in the lower part of the balloon. The beam 7 in this case is situated laterally to the spindle 16, just above the formation of the cops, and the separator 14 has an opening 15 for the passage of the light beam. FIG. 9 shows a possible position of two beams 7, 8 laterally to the spindles 16.

Figure 10:
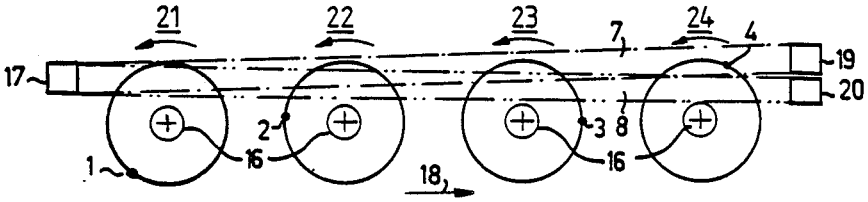

FIG. 10 shows the arrangement of FIG. 9 in greater detail. A beam emitter, for example a luminescence diode, is indicated at 17 and the direction of the beams 7, 8 is indicated by the arrow 18. Beams of this kind generally fan out widely (with the exception of laser beams). The beams therefore strike the receiving elements 19 and 20, which may be conventional commercially available photoelectric diodes. The beam 7 is formed between the transmitter 17 and the receiving element 19 while the beam 8 is formed between the transmitter 17 and the receiving element 20. Electrical impulses are thereby produced, as shown in FIGS. 2, 4 and 6. The basic principle applies that the difference in time enables the production unit to be identified while the magnitude of shading is a measure of the diameter of the thread.

The processing of electric impulses is well known and need not be described here except to mention that the shading is manifested as a voltage or a current impulse which is easily measured. The time difference between the impulses are pure time measurements which can be carried out very accurately by simple means. The voltage or current can easily be converted into binary signals which together with the time measurements provide ideal conditions for electronic data processing. Microprocessors are particularly suitable for this purpose.

In FIGS. 1*a*, 3*a*, 3*b*, 5, 7 and 9 the beams are only shown schematically as straight lines with point cross-section but in practice the cross-section of the beams 7, 8 is determined by the luminous surface of the transmitter 17 and by the surface area of the receiving elements 19 and 20. If these two areas are approximately equal in magnitude, then the impulses of the individual production units are independent of their position, and their interpretation is thereby simplified.

Figure 11:
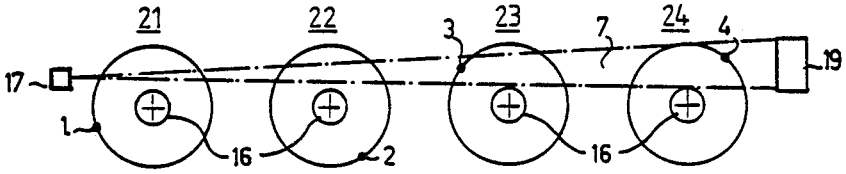
Figure 12A:
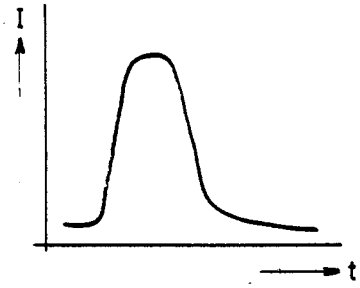
FIG. 12*a* and 12*b* represent examples of impulse forms.
Figure 12B:
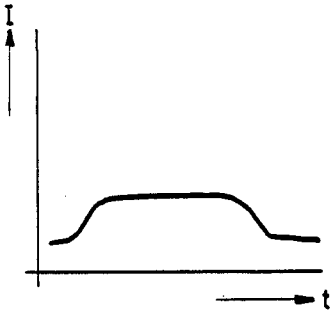

The two surfaces could, however, be deliberately made unequal. For example, as shown in FIG. 11, the transmitter 17 could have a small surface area and the receiving element 19 a large surface area (or conversely). Identification of the production unit is then possible from the length and/or height of the impulse. Interpretation of the impulse then becomes slightly more complicated but on the other hand only a single light transmitter and a single receiving element are required. FIG. 12*a* shows an impulse of the type produced in the production unit 21 of FIG. 11 while FIG. 12*b* shows a corresponding impulse from production unit 24 (FIG. 11).

In all the examples described here, only four production units are shown. This number may easily be increased but is limited by the reliability of allocation of an impulse to the correct production unit, which decreases with increasing spindle number. As a general rule, the upper limit of the number of production units would be about 16. In a machine with, for example, 160 production units, this would require 10 groups of 16 production units each. The cost for each group is then minimal because the interpretation can then advantageously be carried out centrally. Inexpensive systems can be constructed by this arrangement.

The number of production units may be further limited by problems of optics since the intensity of light decreases with the square of the distance between the receiver and the transmitter. Interfering light and noise may then overshadow the useful signal. A considerable improvement may be achieved by modulating the light in known manner to cut out extraneous influences.

Figure 13A:
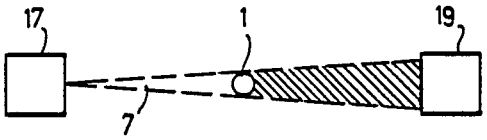
FIG. 13*a* and 13*b* shows examples of positions of the thread in the beam.
Figure 13B:
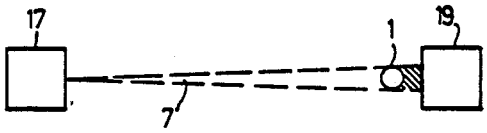

The previous embodiments were used only for detecting thread breakages but the magnitude of the shading is also a measure of the diameter of the thread in the light beam. Moreover, even when the transmitter surfaces and the receiver surfaces are equal, the intensity of the shading depends not only on the diameter but also on the position of the thread between the transmitter and the receiver. This is illustrated in FIG. 13, in which the transmitter 17 sends its light to the receiver 19 and the thread 1 is situated in the immediate vicinity of the receiver 19 (FIG. 13*b*). In that case, the shading is almost equal to the diameter of the thread 1. In FIG. 13*a*, on the other hand, the thread 1 is situated approximately halfway between the receiver 19 and the transmitter 17. It is clear that in this case the area of shading is larger (almost double). This property may be used to identify the production unit of the particular thread if it can be assumed that the thread diameter is sufficiently constant (or if a mean value is obtained from several passages of the thread).

For a given diameter, a given area of shading corresponds exactly to a particular position of thread. If there is a change in thread diameter due to non-uniformities then the size of the shading also changes. Since the thread also moves through the balloon in the longitudinal direction, the light scans a different part of the thread on each occasion. The known parameters of quality, such as the coefficient of variation of non-uniformity, the spectrogram, etc. can then be calculated from a sufficient number of scanning points. A continuous impulse sequence without gaps is not necessary. Interruptions are permissible since sufficient material and time are available for interpretation in an on-line method of measurement.

In the case of twisted yarn, it is sometimes necessary to check the presence of all the individual threads of the yarn. The absence of one or other thread component or the presence of an additional thread component alters the diameter of the thread and therefore the area of shading. It is therefore possible to determine whether the number of individual thread components is correct.

It may sometimes occur that a production unit produces a thread of a different fineness by mistake. In that case, the thread from this production unit would give rise to a different area of shading than a thread of the correct fineness. It is therefore also possible to detect production units producing threads of the wrong degree of fineness.

By including the area of shading in the calculation it is therefore possible at quite low cost not only to detect thread breakages but also to carry out an extensive quality control of each production unit.

Figure 14:
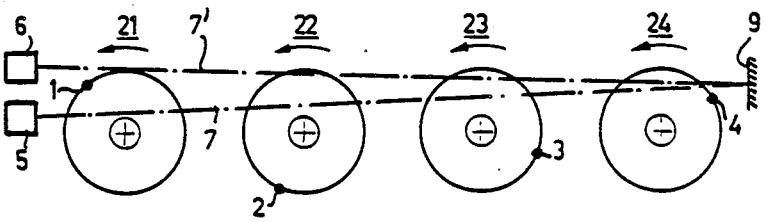
FIG. 14 shows another variation of the arrangement of FIG. 1*a* in plan view.

FIG. 14 shows another possible arrangement for the position of the light beam passing through the balloon, in which the beam 7 passes from the transmitter 5 to a mirror 9 and from there as reflected beam 7' to a receiver 6. The impulse sequences are similar to those of the examples shown in FIG. 5. Only one transmitter and one receiver are required in this case but the beam 7 is twice as long.

Still other modifications and variations will be apparent to persons skilled in the art. Accordingly, the foregoing description of the illustrated embodiments is intended as exemplary only, and the scope of the invention is to be ascertained from the following claims.

What is claimed is:

1. A process for production and quality control of production units in multi-spindle textile machines in which the production units are arranged in a row and the thread at each production unit executes a transverse movement in the form of a balloon to enclose a rotationally symmetrical space, characterized in that a group of at least two of said production units is monitored in common by a light beam passed sequentially through the rotationally symmetrical spaces associated with the balloons formed by the threads in all the production units of said group, in that the light beam is intermittently interrupted or attenuated in each of the rotationally symmetrical spaces by the moving thread therein, and in that the shading thereby produced is converted into an electric signal for evaluation to provide an indication of at least one parameter associated with the threads of said production units.

2. A process according to claim 1, characterized in that four to eight production units are monitored in common and said light beam passes sequentially through all of the rotationally symmetrical spaces associated with the balloons formed at such production units.

3. A process according to claim 2, characterized in that the light beam intersects the axes of said spaces formed at said production units.

4. A process according to claim 2, characterized in that the light beam extends parallel to a line connecting the axes of said spaces at some distance from said line.

5. A process according to claim 2, characterized in that the light beam is directed obliquely to a line connecting the axes of said spaces.

6. A process according to claim 2, wherein each of said spaces is symmetrical about a generally vertical axis, and wherein said light beam is directed obliquely to a horizontal line intersecting the axes of said spaces formed at the production units of said group.

7. A process according to claim 2, characterized in that the individual threads of the production units which are monitored in common are identified by evaluating the intervals of time between the individual electric signals produced by shading.

8. Process according to claim 2, characterized in that the individual threads of production units monitored in common are identified by evaluating the amplitude and/or duration of the electric signal produced by shading.

9. Apparatus for production and quality control of production units in multi-spindle textile machines in which the production units are arranged in a row and the thread at each production unit executes a transverse movement in the form of a balloon to enclose a rotationally symmetrical space, said apparatus comprising a monitoring system for monitoring in common the production units of a group containing at least two of said production units, said monitoring system including a transmitter for a light beam and a receiver for such beam so arranged that the beam passes through said rotationally symmetrical spaces formed at all said production units of said group, and means for evaluating the fluctuations in intensity of the beam occurring at the receiver.

10. Apparatus according to claim 9, wherein said group includes four to eight production units.

11. Apparatus according to claim 10, wherein the monitoring system has a first transmitter for transmitting a divergent light beam and two first receivers for said beam.

12. Apparatus according to claim 11, including two second receivers arranged one on each side of the first transmitter, and a second transmitter arranged between said two first receivers so that said rotationally symmetrical spaces are traversed by two light beams travelling in opposite directions.

13. Apparatus according to claim 10, wherein a transmitter and a receiver are arranged side by side and a mirror is provided to reflect the beam from the transmitter to the receiver.

14. Apparatus according to claim 13, wherein said mirror is positioned so that a beam from said transmitter passes through each of said rotationally symmetrical spaces and so that such beam is reflected from the mirror to the receiver along a path that traverses each of said rotationally symmetrical spaces.

15. Apparatus according to claim 10 for use in production units which are shielded from one another by light-impermeable separators, wherein the separators have openings for the passage of the light beam.

16. In textile apparatus of the type in which a plurality of threads are processed concurrently in a group of different zones, with the thread in each zone being processed so that the thread moves through a balloon path portion in which a moving thread portion swings around an axis of revolution, and in which the balloon path portions of the several zones are disposed in a row, the improvement which comprises light transmitters means for directing at least one beam of light across the balloon path portions of all of said zones in said group so that the moving thread portion in each of said zones will cross said beam during each of its revolutions through its balloon path portion, means for receiving the light from said transmitter means as modified by the passages of said thread portions therethrough and for evaluating the received light.

17. Apparatus according to claim 16, including means for producing an electrical impulse corresponding to each passage of each of said threads across said light beam.

18. Apparatus according to claim 17, including means for providing an indication that at least one of said threads is not moving through the intended balloon path portion when the number of electrical impulses produced during a selected time interval is significantly different from the number of times thread portions from the several zones would be expected to cross said beam in the selected time interval.

19. Apparatus according to claim 18, including means for evaluating the number of electrical impulses produced in each of at least two time intervals spaced apart from one another by a period over which it is unlikely that the threads in the balloon portions of two zones of said group would cross said beam at the same moments and for indicating when the counts in all of said time intervals are deficient.

20. Apparatus according to claim 17 wherein said light transmitter means and said light receiving means are constructed and arranged so that the impulses produced from the light variations caused by a single one of said threads in crossing said light beam are spaced apart by time intervals different from the time intervals by which the impulses produced from the light variations caused by others of said threads, and wherein said evaluating means is operable to distinguish between impulses produced from light variations caused by different threads.

21. Apparatus according to claim 17 wherein said light transmitter means and said light receiving means are constructed and arranged so that the impulses produced from the light variations caused by a single one of said threads in crossing said light beam are shaped differently from the impulses produced from the light variations caused by others of said threads, and wherein said evaluating means is operable to distinguish between impulses produced from light variations caused by different threads.

22. Multiple spindle thread processing apparatus comprising a plurality of production units arranged in a row for processing a plurality of threads concurrently with the thread at each of the production units being swung around an axis of revolution to form a balloon path portion, and a monitoring system for monitoring in common the production units of a group containing a plurality of said production units, said monitoring system including means for transmitting a beam of radiation sequentially through the balloon path portions of the threads at all of the thread production units of the group so that such threads will each cross said beam as the thread swings about its axis of revolution, and means for receiving the radiation of said beam as modified by the passages of thread portions therethrough.

* * * * *